US005282012A

United States Patent [19]

Terada et al.

[11] Patent Number: 5,282,012

[45] Date of Patent: Jan. 25, 1994

[54] COLOR ELECTRONIC PHOTOGRAPHIC APPARATUS WITH MULTIPLE IMAGE FORMING UNITS

[75] Inventors: Hiroshi Terada, Ikoma; Hajime Yamamoto, Ibaraki, both of Japan

[73] Assignee: Matsushita Electric Industrial Co., Ltd., Osaka, Japan

[21] Appl. No.: 952,996

[22] Filed: Sep. 29, 1992

[30] Foreign Application Priority Data

Jan. 20, 1992 [JP] Japan ..... 4-7301
Feb. 4, 1992 [JP] Japan ..... 4-18617

[51] Int. Cl.[5] ..... G03G 15/01

[52] U.S. Cl. ..... 355/327; 355/210; 346/157

[58] Field of Search ..... 355/326, 327, 210, 211; 118/645; 346/157

[56] References Cited

U.S. PATENT DOCUMENTS 4,116,557 9/1978 Kushima et al. .
4,367,942 1/1983 Ohtsuka .
4,905,048 2/1990 Suzuki ..... 355/271
4,937,664 6/1990 Chiku et al. ..... 355/327 X
5,041,877 8/1991 Matsumoto ..... 355/326 X

FOREIGN PATENT DOCUMENTS 1250970 10/1989 Japan .

*Primary Examiner*—R. L. Moses
*Attorney, Agent, or Firm*—Wenderoth, Lind & Ponack

[57] ABSTRACT

A color electronic photographic apparatus includes plurality of image forming units, each having a different electrostatic carrier and a different colored toner. Each of the image forming units can be moved to the same image forming position when exposed to light by a light exposing mechanism at the image forming position so as to effect an image forming operation, so that toner images are individually transferred onto a transfer material. In the color electronic photographic apparatus, the image forming units are sequentially moved into the image forming position, and also, the transfer material is reciprocated by the transfer carrying device so that the toner images of each color are properly superposed on the same transfer material.

20 Claims, 7 Drawing Sheets

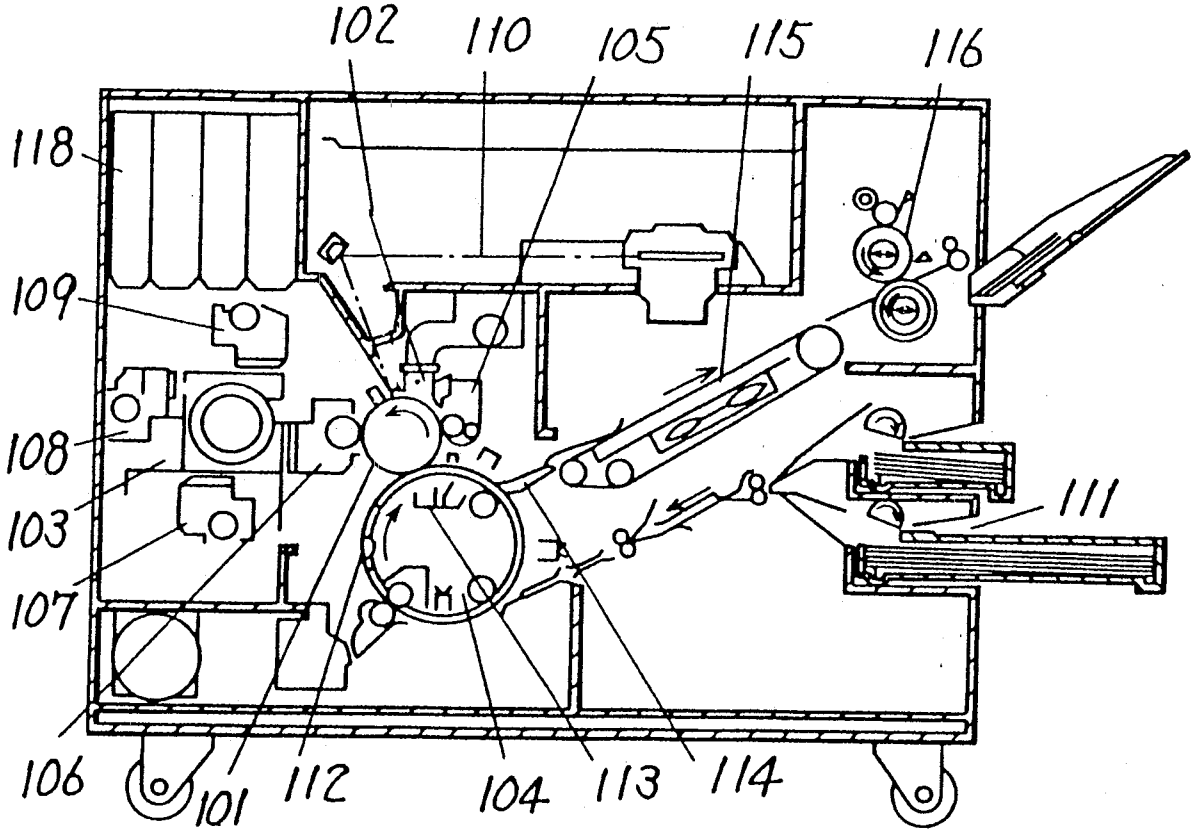
Fig. 7 - PRIOR ART

COLOR ELECTRONIC PHOTOGRAPHIC APPARATUS WITH MULTIPLE IMAGE FORMING UNITS

BACKGROUND OF THE INVENTION

The present invention generally relates to a color electronic photographic apparatus which can be applied to a color duplicating machine, a color printer and so on.

In order to form color images with an electronic photograph, a method of superposing the toner images of the respective colors of yellow, magenta, cyanide, and black on a transfer material so as to form color images is provided. As methods of effecting the superposition of the toner images on the transfer material, there have been provided a transfer drum system for rotating a transfer material around the transfer drum so as to repeatedly bring it to the same image forming position, where the sequentially formed toner images of each color are transferred in piles, and a continuous superposing system for arranging a plurality of image forming portions side by side so as to let the transfer material be carried by belts or the like to pass by the positions of the respective image forming portions so that the toner images of each color are transferred sequentially and are superposed.

There is an example of a color image forming apparatus shown in Japanese Laid-Open Patent Application No. 1-252982, which uses the transfer drum system discussed above.

FIG. 7 shows the overall construction of the conventional embodiment, which will be described hereinafter with respect to its construction and operation. In FIG. 7, reference numeral 101 is a photosensitive material. A charger 102, a developer portion 103, a transfer drum 104, and a cleaner 105 are positioned opposite the photosensitive material 101. The developer portion 103 is composed of a Y developer 106 for making the toner image of a yellow color, an M developer 107 for making a magenta color, a C developer 108 for making a cyanide color, and a K developer 109 for a black color. The respective developers are positioned in sequence opposite the photosensitive material 101 so that the developing operation can be effected through rotation of the whole developer mechanism 103.

The transfer drum 104 and the photosensitive material 101 are rotated at a constant speed in the directions respectively indicated by arrows in FIG. 7 while being positioned opposite one another during the operation.

When the operation starts, the photosensitive material 101 is rotated in the arrow direction, and the surfaces are charged evenly by the charger 102.

A laser beam 110 modulated by a signal for forming the yellow image of a first color impinges upon the surfaces of the photosensitive material so as to form latent images. The latent images are developed first by the Y developer 106 opposite to the photosensitive material so as to form a yellow toner image. One sheet of paper such as a transfer material fed from the paper feeding portion 111 is caught at its tip end by a pawl portion 112 and is already wound on the outer periphery of the transfer drum 104 by the time the yellow toner image reaches a position opposite the transfer drum 104. The timing is set so that the yellow toner image on the photosensitive material may reach a position opposite the given position of the paper so as to form the toner images.

The yellow toner image on the photosensitive material is transferred onto the paper by the function of the transfer charger 113, and thereafter, the photosensitive material surfaces are cleaned by the cleaner 105 so as to prepare for image formation with the next color. The toner images of magenta, cyanide, and black are then sequentially and continuously formed in a similar manner. At this time, each developer of the developer portion 103 is positioned opposite the photosensitive material when it is desired to develop the corresponding color. The diameter of the transfer drum is sufficient for the longest paper to be wound thereabout, and the developer portion 103 may be moved to develop the images of the respective colors.

The illumination by the laser beam 110 for forming images of the various colors is timed so that the toner image of each color and the toner images already transferred onto the paper on the transfer drum may be positioned in conformity. In this manner, four colors of toner images are transferred in a superposed manner onto the paper on the transfer drum 104 so that the color images are formed on the paper. After the toner images of all the colors have been transferred, the paper is peeled off from the transfer drum 104 with the peeling pawl 114. The upper toner images are fixed by a fixer 116 as the paper is carried through the carrying portion 115 to discharge the paper out of the apparatus. The above description is a brief description of the construction and the operation of a conventional embodiment.

Japanese Laid-Open Patent Application No. 1-250970 is among examples of color image forming apparatus using a continuous transferring system. Four colors of image forming stations each including a photosensitive material, a light scanning means and so on are arranged side by side to form four-color images in the example. Paper carried by the belt passes under the lower portion of the respective photosensitive material so as to superpose the toner images.

A method of reciprocating the transfer material with respect to the photosensitive material so as to repeat the transferring operation and superpose the toner images is disclosed in U.S. Pat. No. 4905048 as another method for superposing toner images of different colors on the transfer material so as to form color images.

In the transfer drum system of such conventional embodiments as described hereinabove, a transfer drum is used so as to position the toner images of different colors to provide proper superposition. The transfer drum is rotated at the same speed as the photosensitive material, and further the timing of the movement of the tip end of the image is set so that the mutual positions of the toner images of the different colors are put into conformity. As the paper is required to be wound around the transfer drum in the construction described hereinabove, the diameter of the constant-size transfer drum must be large and the construction is very complicated so that the apparatus is quite large.

It has been impossible to use stiff paper such as postcards, thick paper or the like because it could not be wound around the transfer drum.

The continuous transfer system has a number of image forming positions corresponding to the number of colors. No transfer drum is necessary as the paper has only to pass there one after another. But in this case, the latent image forming means of the laser optical system and so on for forming latent images on the photosensitive material are necessary in accordance with the number of the colors, thus resulting in a very complicated construction in this portion. As the image forming positions are plural in number, the relative positional relation of the image forming portions of the respective colors has a large influence upon the color divergence.

It is especially important to provide correct positional alignment among the respective colors of the latent images by the latent image forming means. This requires a complicated construction of the image light exposing system as the latent image forming means as shown by way of example in Japanese Laid-Open Patent Application No. 1-250970.

In the example disclosed in the U.S. Pat. No. 4905048 for reciprocating the transfer material, the photosensitive material becomes large as the toner images of the various colors are formed in order on one photosensitive material, and the construction and control for combining the sensitive body with the developer for each color is very complicated such that the maintenance required to exchange them is difficult.

SUMMARY OF THE INVENTION

Accordingly, the present invention has been developed with a view to substantially eliminating the above discussed drawbacks inherent in the prior art, and has for its essential object to provide an improved color electronic photographic apparatus.

Another important object of the present invention is to provide a color electronic photographic apparatus which requires neither complicated transfer drums nor complicated construction for positioning alignment of the image light exposing system, and is capable of providing correct positional alignment of various colors with a small sized and simple construction.

A further important object of the present invention is to provide a color electronic photographic apparatus for which the construction of the toner image forming portion including the photosensitive material and the developer is simple, and the maintenance is easier.

In accomplishing these and other objects, according to one preferred embodiment of the present invention, the present invention is a color electronic photographic apparatus which comprises a plurality of movable image forming means that are provided with plural developing means having electrostatic image carriers, each being rotatable, and toners of different colors, and that is capable of forming toner images of different colors, a transfer carrying means capable of moving a transfer material along a predetermined path, a transfer means for transferring onto the transfer material the toner images provided on the above described electrostatic image carriers at a single transfer position, a light exposing means for effecting an image light exposing operation at a single light exposing position corresponding to the above described transfer position, a moving means for sequentially moving each of the above described plurality of image forming means to the image forming position corresponding to the above described light exposing position, so that the toner images of different colors are properly superposed on the transfer material so as to form color images.

With the above construction, the image forming operations for the various colors can all be effected at the same image forming position without the use of a transfer drum. Thus, correct positional alignment of the various colors can be effected with a simple construction. As each of the image forming units is a complete image forming means, and is independent of the other image forming units, the construction is simple and the image forming units for the different colors can be exchanged. This results in an apparatus which is easier to maintain. Other superior functional effects of the present invention will be clear from the following detailed description of the present invention.

BRIEF DESCRIPTION OF THE DRAWINGS

These and other objects and features of the present invention will become apparent from the following description of preferred embodiments with reference to the accompanying drawings, in which:

FIG. 7 is a schematic diagram of a conventional color electronic photographic apparatus.

DETAILED DESCRIPTION OF THE INVENTION

Figure 1:
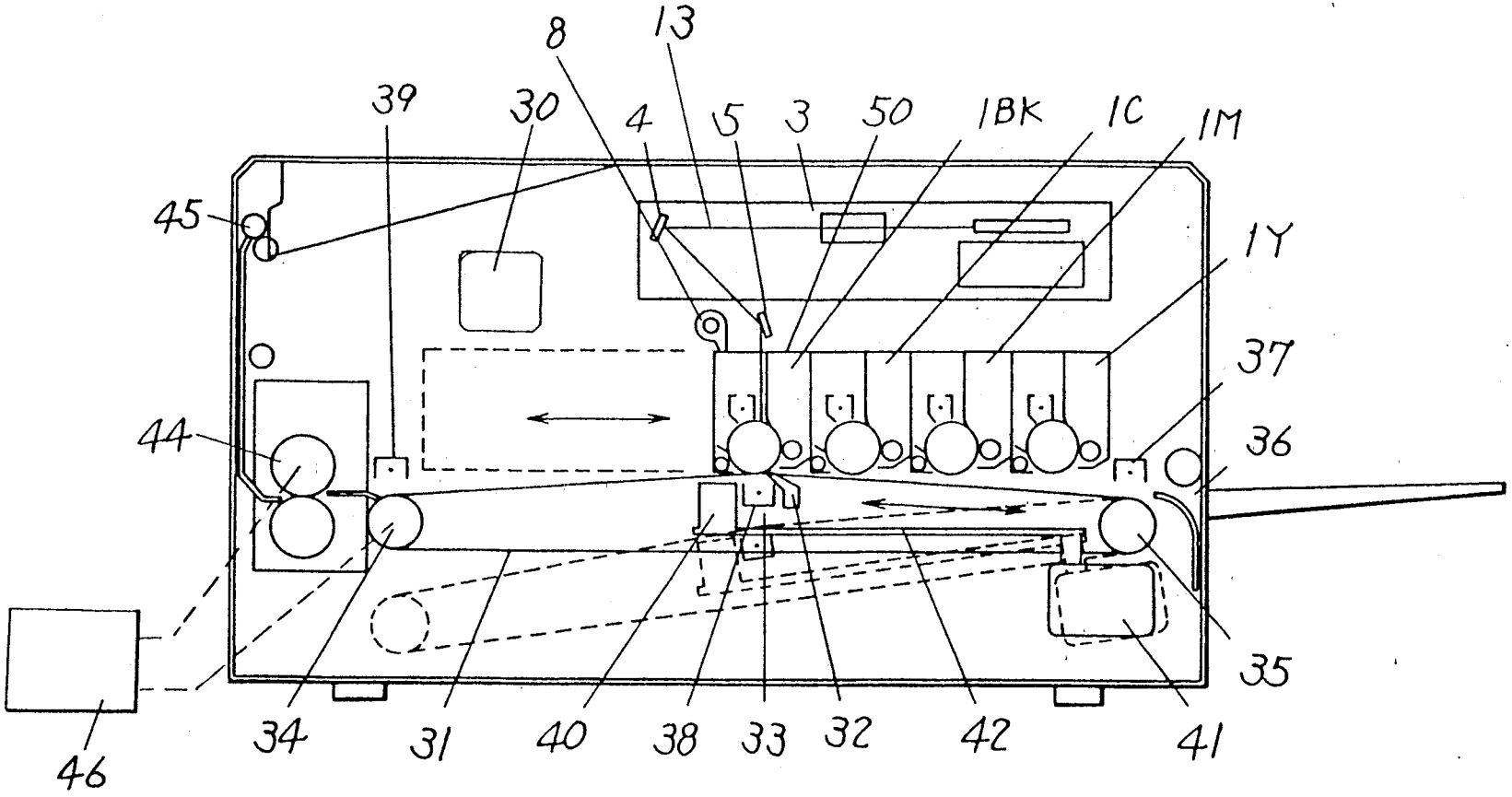
FIG. 1 is a schematic diagram of a color electronic photographic apparatus in a first embodiment of the present invention.

Before the description of the present invention proceeds, it is to be noted that like parts are designated by like reference numerals throughout the accompanying drawings.

An electronic photographic apparatus of the present invention will be described hereinafter with reference to the drawings.

A color electronic photographic apparatus in a first embodiment of the present invention will be described hereinafter with reference to the drawings.

FIG. 1 shows only a printer portion where the image formation of the color electronic photographic apparatus of the present invention is produced.

Four image forming units 1BK, 1C, 1M, 1Y are disposed side by side and include image forming means for forming black, cyanide, magenta, and yellow colors, respectively. As the image forming units are respectively identical except for the developers which are incorporated therein, the image forming unit for forming magenta images will be described, with the other color image forming units being omitted for simplification. The same parts are designated by the same reference numerals for each color unit. When there are differences among the units, letters representing the respective colors are added to the reference numerals. The image forming unit 1M for forming magenta images is shown in detail in FIG. 2.

Figure 2:
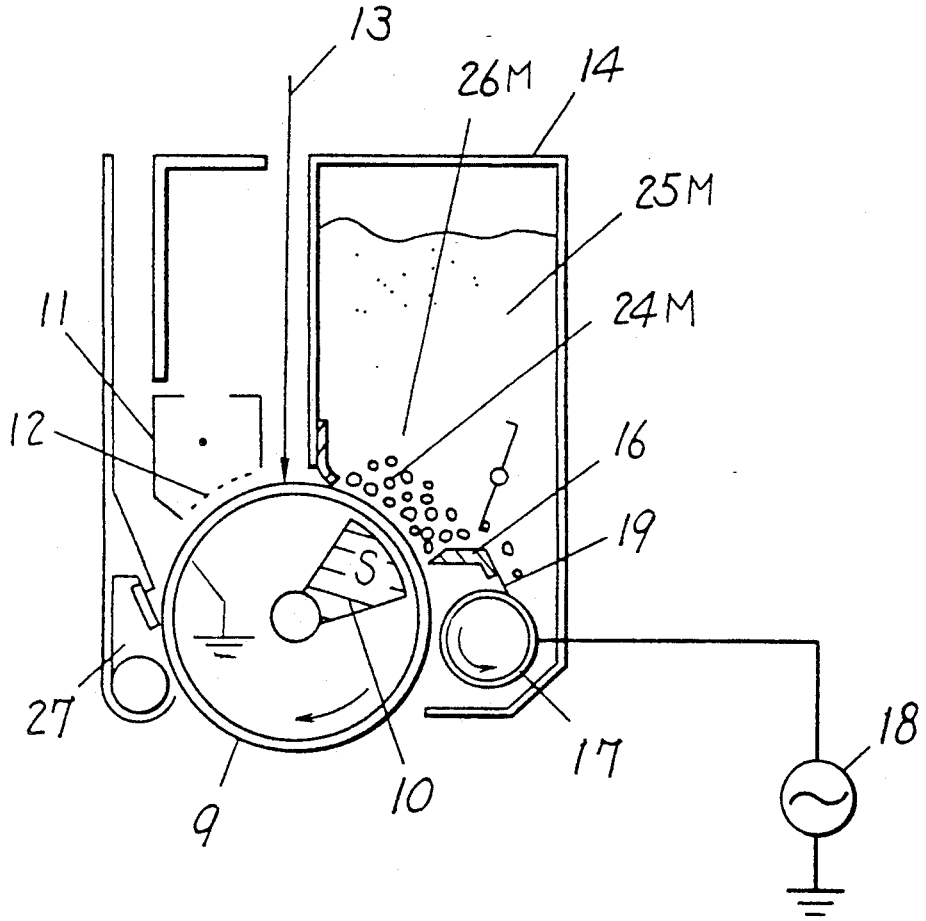
FIG. 2 is a schematic diagram of an image forming unit to be used in the color electronic photographic apparatus in the first embodiment of the present invention.

In FIG. 2, reference numeral 9 is a drum-shaped organic photosensitive material which functions as an electrostatic image carrier with futarocyanine being dispersed in a polyester binder resin, reference numeral 10 is a magnet fixed to a rigid shaft coaxial to the axial center of the photosensitive material 9, reference numeral II is a corona charger for negatively charging the photosensitive material, reference numeral 12 is a grid electrode for controlling the charging potential of the photosensitive material, reference numeral 13 is a laser beam scanning light, and reference numeral 14 is a toner hopper.

Two component developers 26M where an iron powder carrier 24M, of 100 μm in grain diameter and which is coated with silicone resin, and a toner 25M are blended, are put into a toner hopper 14, and are adhered on the surfaces of the photosensitive material 9 by a magnetic force of the magnet 10.

Reference numeral 16 is a toner amount controlling blade made of nickel which is a magnetic material, reference numeral 17 is a toner recovering electrode roller made of aluminum, reference numeral 18 is an alternating current high voltage power supply for applying a voltage to the toner recovering electrode roller 17, reference numeral 19 is a scraper made of polyester film for scraping down the toner on the toner recovering electrode roller 17. The maximum magnetic flux density on the surface of the photosensitive material 9 is 800 gausses. The photosensitive material 9 is 30 mm in diameter and is rotated, at its periphery, at 120 mm/s.

Reference numeral 27 is a cleaner for cleaning the toner remaining on the photosensitive material surface after the transfer operation. The operation of the image forming unit constructed as described hereinabove will be described with reference to FIG. 2. The photosensitive material 9 is charged to −500 V by the corona charge 11 (application voltage −5 kV, voltage −500 V with grid 12). The laser beam scanning light 13 illuminates the photosensitive material 9 so as to form electrostatic latent images. At this time, the light exposure potential of the photosensitive material is −100 V.

When the photosensitive material 9 with electrostatic latent images formed on it passes by the developer 26M, the carrier 24M is adhered on the magnet and does not move. Only the toner 25M moves together with the photosensitive material 9. After photosensitive material 9 passes the toner amount controlling blade, a uniform toner layer of approximately 30 μm is obtained on the photosensitive material 9. At this time, the voltage of −500 V is applied to the toner amount controlling blade 16.

At this time, the toner is charged to approximately −3μC/g. Then, the photosensitive material 9 with the toner layer being adhered on it is made to pass the toner recovering electrode roller 17. An AC voltage (frequency 300 Hz) of 400Vo-p (peak to peak 800V) with a DC voltage of −300V being piled upon it is applied to the toner recovery electrode roller 17 by the high voltage power supply 18. The toner layer on the photosensitive material 9 is reciprocated between the photosensitive material 9 and the toner recovering electrode roller 17. Gradually the toner of the non-image portion is moved onto the toner recovering electrode roller 17 side. The toner images inverted in both negative and positive on the image portion remain on the photosensitive material 9. The toner adhered on the toner recovering electrode roller 17 is scraped by the scraper 19, and returned to the toner hopper 14 so as to be used for the next image formation. The magenta toner images are obtained on the photosensitive material 9 in this manner.

The other developing apparatuses 1BK, 1C, 1Y are similar in construction and operation to the magenta unit 1M.

The construction of a printer portion will be described hereinafter, again with reference to FIG. 1.

The image forming units 1BK, 1C, 1M, 1Y to be arranged side by side are collectively driven by a moving motor (or moving means) 30 which can move in a horizontal direction. The respective image forming units can be sequentially positioned at an image forming position 50 opposite a transfer portion (or transfer area) 33 slightly raised by a belt controlling material 32 of the transfer belt 31.

Reference numeral 3 is a laser light exposing apparatus which generates a laser beam scanning light 13 modulated with signals inputted into a printer portion. The laser beam scanning light is reflected by mirrors 4, 5 and caused to impinge upon the photosensitive material of the image forming unit located in the first image forming position 50 so as to form a latent image. In the conduction of FIG. 1, an operation is effected upon the black image forming unit 1BK.

Reference numeral 8 is an eraser lamp secured to a main body, which is in a position for illuminating the surface after the cleaning operation of the sensitive body of the image forming unit provided in an image forming position 50.

The transfer belt 31 is composed of an endless belt shaped polyester film of 100 μm in thickness, and is wound around a driving roller 34 and a roller 35. Paper is adhered on the surfaces thereof so that it can be reciprocated. In the present embodiment, the distance between the driving roller 34 and the roller 35 is set slightly longer than twice the length of the shorter side of an A4 form. An adhering charger 37 for adhering the paper to be fed from a paper feeding portion 36 on the polyester film is provided at the right hand end of the transfer belt. A transfer charger 38 is disposed at the transfer portion 33. A discharger 39 for discharging the paper separated from the transfer belt 31 and fed to the left is disposed at the left end of the belt 31.

In the present embodiment, the transfer belt is composed of an insulating polyester film. In addition, it may be composed of films made of semiconductive material with carbon and so on being dispersed in, for example, polyester, urethane and so on. As the electric charge at the charging time does not easily gather in the transfer belt in this case, the superposed transferring operation is further simplified.

Reference numeral 40 is a toner receiver for receiving excess toner discharged from the cleaner 27 when each image forming unit operates in the image forming position. Reference numeral 41 is a belt cleaner portion including a belt cleaner for cleaning the transfer belt. The toner receiver 40 is coupled to the belt cleaner portion 41. The excess toner discharged from each image forming unit in the image forming position 50 is gathered in the belt cleaner portion 41.

The transfer belt 31, the transfer discharger 38, the belt cleaner portion 41 and so on are adapted to be collectively moved to positions shown in FIG. 1 by dotted lines when clogged with paper.

Reference numeral 44 is a fixing unit for fixing toner images on the form after the transferring operation, and reference numeral 45 is a discharge roller for discharging the paper after the fixing operation. The driving operation of the driving roller 34 and the fixing unit 44 of the transfer belt is respectively controlled by a carrying (or drive) control means 46.

The above description is a description of the major construction of the electronic photographic apparatus of the present invention.

The operation of the apparatus will be described hereinafter with respect to formation of a color image on A4 sized paper.

A4 paper (not shown) is fed from the paper feeding portion 36 in a direction along its shorter side. The paper is moved in the left hand direction (hereinafter referred to as forward direction) at a fixed speed on the transfer belt while the paper is adhered on the transfer belt 31 with the operation of the adhering charger 37. At this time, the paper is positively adhered on the transfer belt 31, so that the transfer belt and the paper are not deviated in position from each other if the transfer belt is reciprocated as described later, so that the paper is easier to arrange in position when the toner images of the different colors are superposed.

At first, the image forming unit is in a position as shown in FIG. 1, and a black image forming unit 1BK is in an image forming position 50 confronting the transfer portion 33. A black signal light is inputted to the image forming unit 1BK by the laser light exposing apparatus 3, and the timing is set when the paper is carried on the transfer belt from the right so that the images are formed by the black toner. At this time, an image forming speed (which is equal to the peripheral speed of the sensitive body) of the image forming unit 1BK is set to be the same as the moving speed of the transfer belt. The black toner images are transferred onto the paper by the operation of the transfer charger 38 through movement of the paper as the images are formed. Immediately after the trailing end of the paper has passed the transfer portion after the completion of all the transferring operations of the black toner images, the movement of the transfer belt is stopped and then is moved in a direction opposite the forward direction (hereinafter a reverse direction) at a speed greater than the previous moving speed. At this time, the leading end of the paper is near the driving roller and cannot be peeled off from the transfer belt as the length of the transfer belt is sufficiently long.

At approximately the same time as the beginning of movement in the reverse direction of the transfer belt, all of the image forming units 1BK, 1C, 1M, 1Y are driven by the moving motor 30 and move integrally in the left hand direction as shown in FIG. I. The reverse direction moving speed of the transfer belt and the moving time of the image forming units is set so that the image forming unit IC reaches the image forming position 50 immediately after the paper moves in the reverse direction and the trailing end thereof has almost passed the transfer portion. As the bottom portion of the toner hopper 14 (see FIG. 2) is positioned above the photosensitive material during this time, the black images on the paper are not disturbed by contact with the image forming unit.

The paper trailing end passes the transfer portion 33 in the right-hand direction, and the image forming unit 1C arrives at the image forming position 50. Thereafter, the transfer belt is moved again at a constant speed in the forward direction. In the same manner as before, the laser light exposing apparatus inputs the signal lights into the image forming unit 1C with a signal of cyanide so as to form and transfer the toner images of the cyanide. At this time, the timing of the start of movement of the transfer belt is controlled so that the cyanide toner image may be conformed in position with the black toner image on the paper with respect to the start of the signal light.

The same operation as described hereinabove is effected for the magenta and a the yellow colors, and the color image is formed with four toner images being superposed in positional conformity on the paper. After the transfer operation of the last yellow toner image, the transfer belt keeps moving in the forward direction. The paper with color images being formed on it is separated from the transfer belt, is discharged by the operation of the discharger 39, and is discharged from the apparatus, with the toner images being fixed by the fixing unit, by the discharging roller.

The distance between the driving roller 34 of the transfer belt and the roller 35 is set slightly greater than seven-fourths of the total length in the horizontal direction of FIG. 1 of the image forming unit group. If the image forming unit group moves integrally until each of the image forming units reaches the image forming position, it does not hit the adhering charger 37 and the discharger 39.

As the charge is sufficiently removed when the paper is separated from the transfer carrying belt, the toners on the paper are not scattered away and pretty color images are obtained.

As the leading end of the paper does not reach the fixing unit immediately after the transfer of the last toner images has been completed, the forward direction moving speed of the transfer belt and the speed of the fixing unit are lowered by the operation of the carrying control means 46 through a change in the operation mode so that a low speed fixing operation can be effected. Therefore, glossy color images and pretty OHP which are superior in transmission property can be made.

During operation, the surface of the photosensitive material in the image forming position is cleaned with the cleaner 27 (see FIG. 2) after the transfer operation. Toners to be discharged at this time are collected at the belt cleaner portion 41 by the toner receiver 40 and a coupling portion 42. Also, the toners scattered on the transfer belt are cleaned during the operation in the belt cleaner portion.

The above description is a description of the operation in an A4 color mode of the electronic photographic apparatus of the present invention.

The operation of the apparatus in a single color mode will be described hereinafter.

During operation in the single color mode, the image forming unit of a given color is moved to the image forming position before the paper reaches the transfer position. Then, the image formation of a given color and the transferring operation are effected in the same manner as before. After the transferring operation, the transfer belt moves continuously in the forward direction so as to effect a fixing operation and a discharging operation of the paper. Therefore, in the single color mode, A4 size or other, for example, A3 paper can be used. The excess toner to be discharged from the cleaner at this time is collected at the belt cleaner portion 41 through the coupling portion 42 on occasion.

The construction of the apparatus for exchange of the image forming unit will be described hereinafter.

Figure 3:
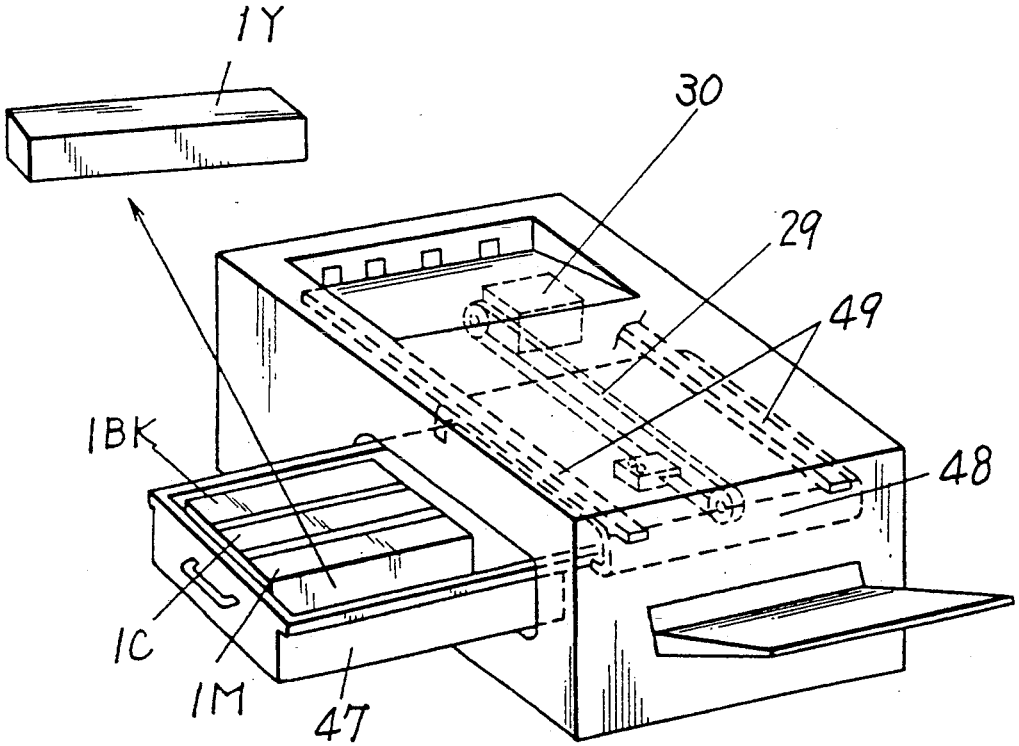
FIG. 3 is a perspective view showing a condition in which an image forming unit of a color electronic photographic apparatus in the first embodiment of the present invention is removed from the apparatus.

FIG. 3 shows a condition in which one of the image forming units 1Y is removed from the apparatus. A first supporter 47 for supporting the image forming unit group 1BK through 1Y is adapted to move in the apparatus depth direction with respect to a second supporter 48. Further, the second supporter 48 is engaged with a portion of the belt 29 to be driven by the moving motor 30 so as to be able to move in the lateral width direction of the apparatus along rails 49 fixed to the main body. In order to exchange an image forming unit, the image forming unit group is pulled out together on one side of the apparatus as shown in FIG. 3. Further, the respective image forming units are adapted to be independently removed upwardly from the first supporter 47.

The above description is a description of the construction and operation of the first embodiment.

By the above described construction, all the respective color image forming operations can be effected in a small image forming position without the use of a transfer drum of complicated construction so that a correct positional alignment of colors can be effected by an apparatus of simple construction. As a complete independent image forming means is provided for each of colors, the construction is simple and has superior maintenance properties in that the image forming means can be exchanged for each color.

The image forming and transferring operations are sequentially effected by each color image forming unit during the reciprocating movement of the transfer paper on the transfer belt so as to effect a superposing operation. The carrying speed of the transfer paper is lowered in a particular mode at the time of making of the OHP or the like so as to effect a sufficient fixing operation so that the pretty color images can be made with a simple and small sized apparatus.

An image forming unit group is adapted to be integrally pulled out of the apparatus and the respective image forming units are adapted to be individually exchanged so that an apparatus which is superior in maintenance properties such as exchange, maintenance and so on of the image forming units is provided.

As the respective image forming units including the photosensitive material can be individually adjusted externally of the apparatus in the present construction, units previously adjusted at, for example, the time of shipment from the factory can be easily exchanged on the spot.

In the single color mode, the transfer belt can be moved continuously in only the forward direction so as to effect an image formation so that the single color image formation can be effected fast and the image forming operation can be effected even on paper of A4 size or longer.

The maintenance properties can be improved with a simple construction by the treatment of the excess toner from the image forming unit and the excess toner from the transfer belt at the excess toner sink.

Further, in the present construction, stable picture images without electrostatic fatigue can be obtained as the respective photosensitive materials are always at rest when the other colors are being formed even when the color images are continuously formed.

A second embodiment of the present invention will be described in construction and operation hereinafter.

An electronic photographic apparatus in a second embodiment of the present invention will be described hereinafter with reference to the drawings.

Figure 4:
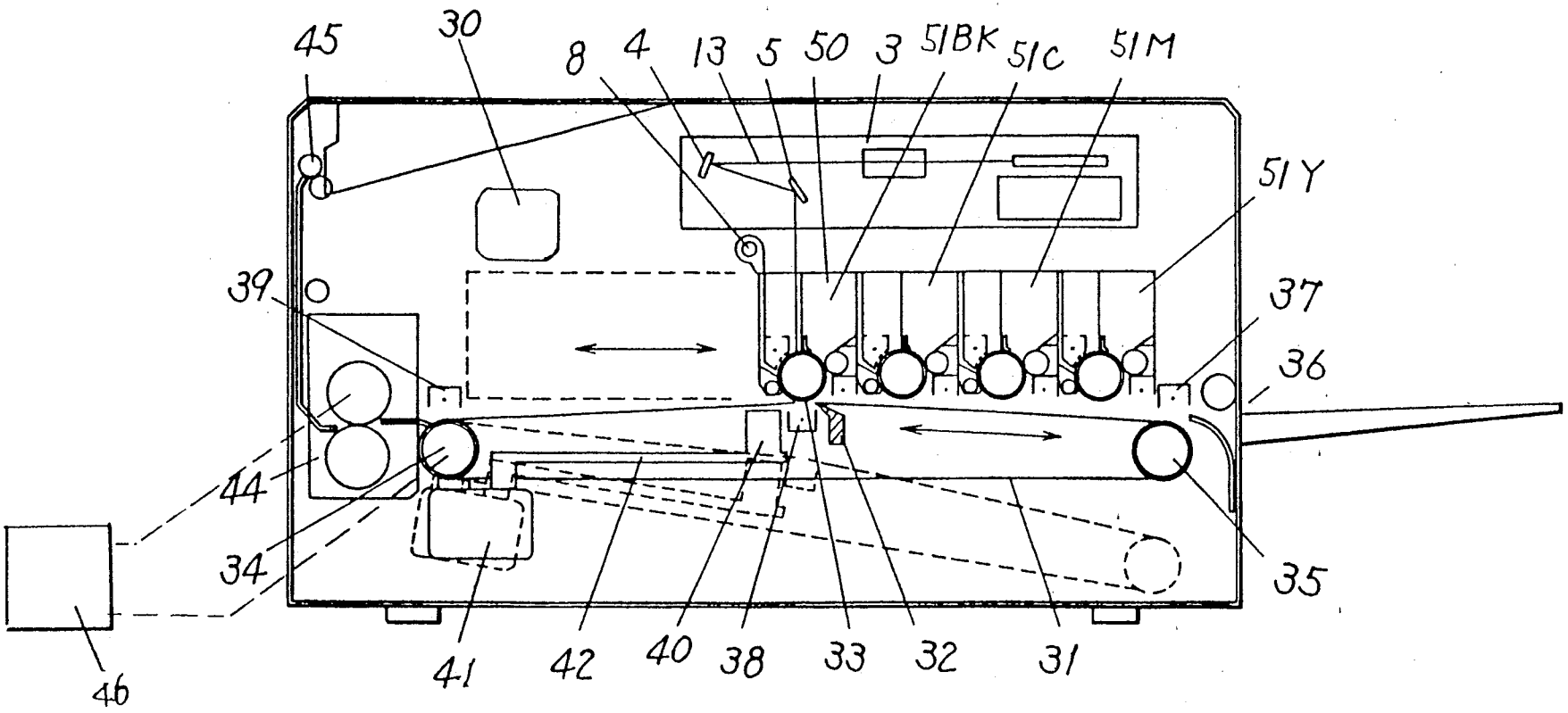
FIG. 4 is a schematic diagram of a color electronic photographic apparatus in a second embodiment of the present invention.

FIG. 4 shows only a printer portion for forming the images of the color electronic photographic apparatus in the second embodiment of the present invention. The same reference numerals as those of the first embodiment are given to components which are the same as those in the first embodiment. Further, description of construction and operations which are the same as in the first embodiment are omitted.

The differences in the second embodiment relative to the first embodiment include certain operations relating to portion of the image forming unit and the maintenance thereof.

In the present embodiment, four image forming units for the respective colors of black, cyanide, magenta, and yellow are shown as 51BK, 51C, 51M, and 51Y. As each of the respective image forming units is substantially the same except for developers to be put thereinto, the image forming unit for forming magenta images will be described but the image forming units for the other colors will not be described for simplification. The magenta image forming unit 5IM will be described in detail with reference to FIG. 5.

Figure 5:
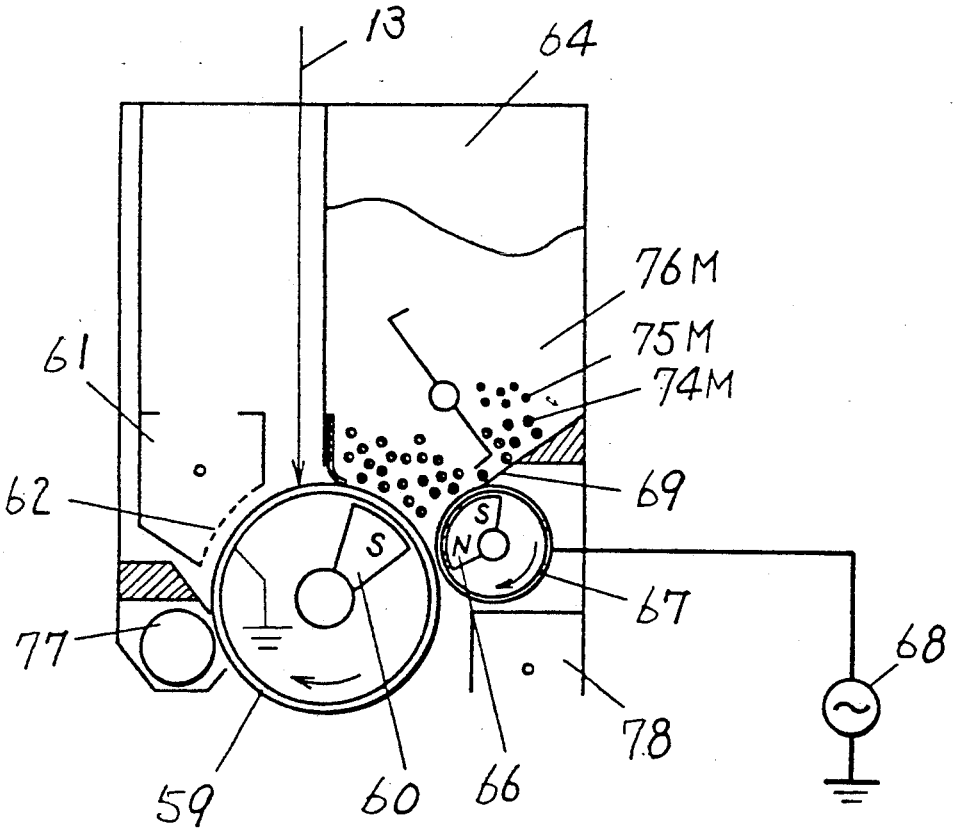
FIG. 5 is a schematic diagram of an image forming unit to be used in the color electronic photographic apparatus of the second embodiment of the present invention.

In FIG. 5, reference numeral 59 is an organic photosensitive material with futarocyanine being dispersed in a polycarbonate system binder resin, reference numeral 60 is a nonrotating magnet fixed coaxially with the photosensitive material 59, reference numeral 61 is a corona charger for negatively charging the photosensitive material, reference numeral 62 is a grid electrode for controlling the charging potential of the photosensitive material, reference numeral 13 is a laser beam scanning light, and reference numeral 64 is a developer hopper.

Two component developers 76M where felite carrier 74M, which has a grain diameter of 50 μm and which is coated with silicone resin, and a toner 75M are blended are put into a developer hopper 64, and are adhered on the surfaces of the photosensitive material 59 by a magnetic force. The toner to be used has pigment dispersed in polyester resin, with an addition agent being added to it.

Reference numeral 67 is a rotatable recovering electrode roller made of aluminum, reference numeral 66 is a non-rotatable magnet fixed coaxially within the roller 67, reference numeral 68 is an AC high voltage power supply for applying the voltage to the recovering electrode roller, reference numeral 69 is a scraper made of polyester film for scraping down the toner on the recovering electrode roller. A maximum magnetic flux density on the surface of the photosensitive material 59 and on the recovering electrode roller surface are respectively 800 gausses. The photosensitive material 59 is 30 mm in diameter and is rotated at a peripheral speed of 120 mm/s in a direction of the arrow in FIG. 5. The recovering electrode roller 67 is 16 mm in diameter and is at a peripheral speed of rotated 100 mm/s in a direction of the arrow in FIG. 5.

Reference numeral 27 is a cleaner for cleaning the toner remaining on the photosensitive material surface after the transfer operation. Reference numeral 78 is a discharger which operates to discharge the paper immediately under it as well be described later from the transfer belt.

The operation of the image forming unit constructed as described hereinabove will be described hereinafter with reference to FIG. 5. The photosensitive material 59 is charged to −500V with a corona charger 61 (application voltage −5 kV, voltage −500V with grid 62).

Laser beam scanning light 13 is caused to impinge upon the photosensitive material 59 so as to form electrostatic latent images. At this time, the light exposure potential of the photosensitive material is −100V.

The two component developers 76M are adhered by a magnetic a force on the surfaces of the photosensitive material 59. Then, the photosensitive material 59 is made to pass before the electrode roller 67, at which as the photosensitive material 59 passes through the uncharged region, the alternating current voltage (frequency 1 kHz) of 750 Vo-p (peak to peak 1.5 kV) with the direct current voltage of the OV being piled up on it is applied on the electrode roller 67 by the alternating current high voltage power supply 68. Thereafter, as the photosensitive material 59 charged to −500V and stored in electrostatic latent image passes, the alternating current voltage (frequency 1kHz) of 750 Vo-p (peak to . peak 1.5 kV) with the direct current voltage of −350 V being piled up on it is applied to the electrode roller 67 by the alternating power high voltage power supply 68. A carrier on the photosensitive material 59 and a toner attached on the charged portion are recovered on the electrode roller 67, and only toner images inverted negative and positive on the picture image portion remain on the photosensitive material 59. The carrier and the toner attached on the electrode roller 67 to be rotated in the direction of the arrow in FIG. 5 are scraped by the scraper 69, and are returned again into the developer hopper 64. They are used for the next image forming operation.

In this manner, magenta toner images are obtained on the photosensitive material 59.

The other developers 51BK, 51C, 51Y have a construction similar to that of the magenta unit 51M, and also operate similarly.

The construction and the operation of the printer operation will be described again with reference to FIG. 4. The construction is almost similar to that of the first embodiment.

In the present embodiment, the transfer portion of the transfer belt 31 is slightly raised from the other portion and is brought into the contact against the photosensitive material of the image forming unit existing in the light exposing position. An alternative construction is possible in which the transfer belt may be flat and the image forming unit to be operated may be slightly lowered only when an image is to be formed.

The operation of the apparatus during formation of a color image on size A4 paper will be described hereafter.

The A4 form (not shown) is fed from a paper feeding portion 36 in a direction along its shorter side, is placed on the transfer belt 31 and is adhered thereto by the operation of the adhering charger 37, and is moved in the left hand direction at a constant speed.

At first, the image forming unit is in a position as shown in FIG. 4, and the black image forming unit 5IBK is in an image forming position 50 opposite the transfer portion 33. A black signal light is inputted into the image forming unit 51BK by a laser light exposing apparatus 3 when the paper is being carried on the transfer belt from the right. An image forming operation with the black toner is effected. At this time, the speed (peripheral speed of the photosensitive material) of the image formation of the image forming unit 51BK is set to be the same as the moving speed of the transfer belt. The black toner image is transferred onto the paper form by the function of the transfer charger 38 through the movement of the paper during the image formation. Immediately after the trailing end of the paper has passed the transfer portion after the completion of the transferring operation of all the black toner images, the movement of the transfer belt is stopped. The paper is then moved in a direction opposite the previous direction (referred to as the reverse direction) at a speed greater than the previous forward moving speed. At this time, the tip end of the paper is close to the driving roller as the length of the transfer belt is sufficiently long. The tip end thereof does not tear off from the transfer belt.

At approximately the same time as the beginning of movement in the reverse direction of the transfer belt, the image forming unit group 51BK, 51C, 51M, 51Y is driven by the moving motor 30, and are all moved together at a high speed in the left hand direction of FIG. 4. They are stopped in the positions shown in FIG. 6. At this time, the high voltage of the alternating current is applied upon the discharger 78 and the transfer charger 38 attached to the image forming unit 51BK so as to remove the power while the paper having the toner images and the transfer belt are moving and passing in opposite directions.

As the bottom portion (see FIG. 5) of the image forming unit is positioned above the photosensitive material during this period, the black toner images on the paper are not disturbed by contact with the image forming unit. The image forming unit 51C is moved into the image forming position immediately after the rear end of the paper has passed. The subsequent operation is effective to superpose the toner images and fix them so as to make color images in the same manner as in the first embodiment.

The operation of the second embodiment in the single color mode is completely the same as the first embodiment.

The construction for exchange of the image forming unit of the apparatus will be described hereinafter. For example, except when the image forming operation is being carried out, the image forming unit is set by the moving motor 30 so as to be positioned as shown in FIG. 6.

Figure 6:
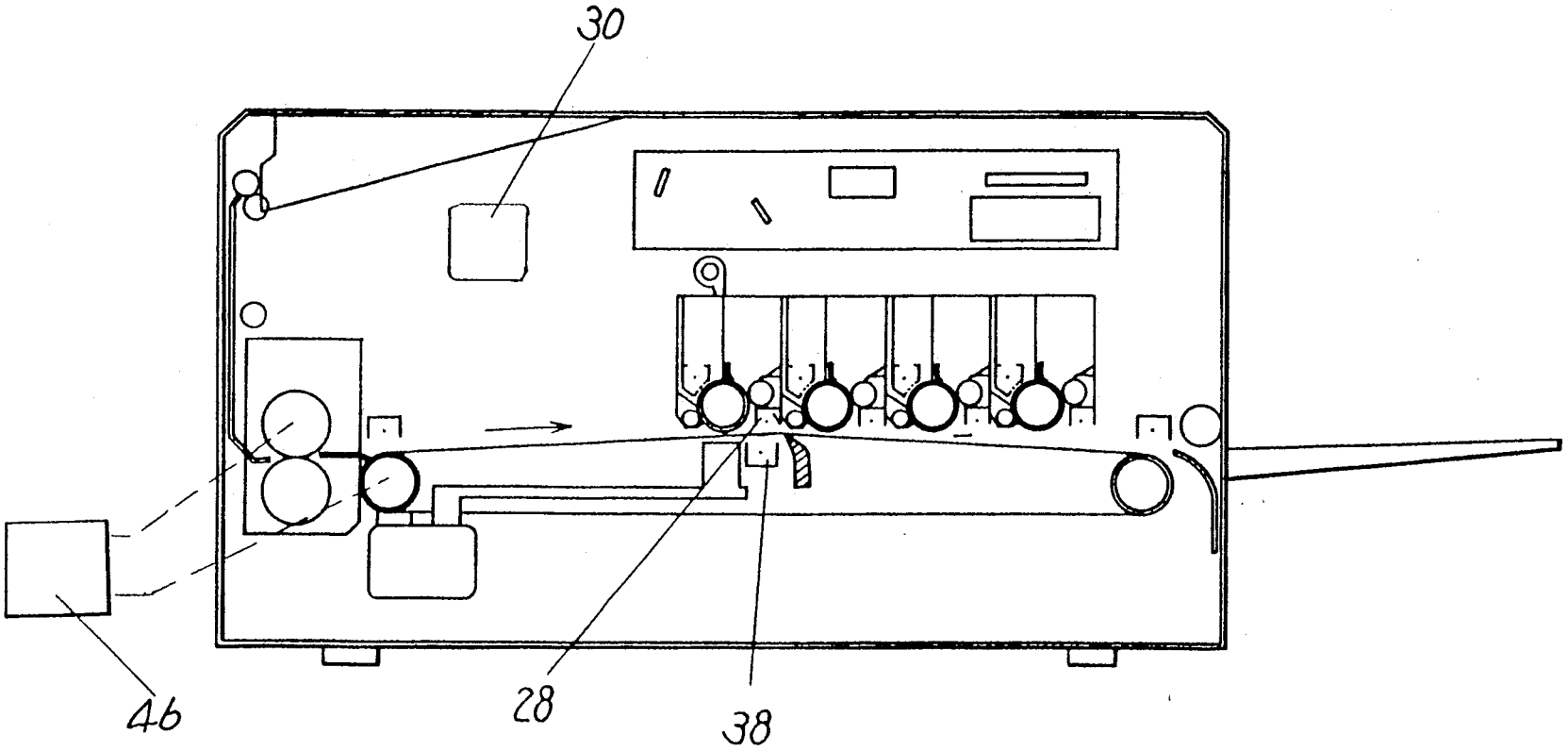
FIG. 6 is a schematic diagram showing a position of the image forming unit in a particular condition of the color electronic photographic apparatus in the second embodiment of the present invention.

Therefore, the image forming unit is positioned as shown in FIG. 6 even during exchange of the image forming unit, and the image transfer belt and the image forming unit are separated from each other. When the image forming unit group is pulled out from the apparatus in the same manner as explained with reference to FIG. 3 for the first embodiment, the units are not rubbed against each other.

The construction and operation of the color electronic photographic apparatus in the second embodiment are described hereinabove.

The transfer belt is adapted to not come into contact against a portion except for the photosensitive material drum of the image forming unit which is located in the light exposing position in the present construction as described hereinabove, such that no image forming unit is provided in the light exposing position except during operation. The image forming units can be integrally pulled out of the apparatus without influencing affecting the simple construction of the other parts. The apparatus is superior in maintenance properties such as exchange and maintenance of the image forming unit. As each image forming unit including the photosensitive material can be externally adjusted individually, for example, a unit previously adjusted at the time of shipment from the factory can be exchanged with ease on the spot.

A color electronic photographic apparatus capable of carrying out superior superposed transferring operations can be provided, because a discharging means which is attached to the image forming unit group is provided so as to discharge the paper and the belt for each transferring operation of the respective colors, and to effect beautiful superposing transfer operations.

Although a specific construction of the image forming unit was set forth above, the essential qualities and the operational effects remain unchanged even when an image forming unit of a construction which uses the conventional developing method is added to it.

Although the present invention has been fully described by way of example with reference to the accompanying drawings, it is to be noted here that various changes and modifications will be apparent to those skilled in the art. Therefore, unless such changes and modifications otherwise depart from the scope of the present invention, they should be construed as included therein.

I claim:

1. A color electronic photographic apparatus comprising:

a main body;

a plurality of image forming units in a straight line and movably mounted in said main body input each of said image forming units including a rotatable electrostatic image carrier and a developing means for developing a toner image on said electrostatic image carrier, the toner images developed by the developing means of the image forming units being of different colors, respectively;

transferring means for transferring the toner images from said electrostatic image carriers onto a transfer material at a single predetermined transfer position along said line;

moving means for sequentially moving each of the image forming units to a single predetermined image forming position opposite said transfer position;

a light exposing means for effecting an image light exposing operation at a single predetermined light exposing position which corresponds to said image forming position; and a transfer carrying means for carrying the transfer material along a predetermined path which extends through said transfer position;

whereby toner images of different colors can be superposed on the transfer material to form color images.

2. A color electronic photographic apparatus as recited in claim 1, wherein said transfer carrying means comprises a transfer belt and is operable to move the transfer material along said path in a reciprocating manner.

3. A color electronic photographic apparatus as recited in claim 2, wherein said plurality of image forming units are positioned together to form an image forming group extending over a predetermined length; and said transfer belt extends over a predetermined length which is at least seven-fourths times said length of said image forming group.

4. A color electronic photographic apparatus as recited in claim 1, further comprising mounting means for mounting said plurality of image forming units in said main body such that said image forming units can be individually removed.

5. A color electronic photographic apparatus as recited in claim 1, further comprising mounting means for mounting said plurality of image forming units in said main body in such a manner that said image forming units can be pulled out of said main body together as a group.

6. A color electronic photographic apparatus as recited in claim 5, wherein said mounting means is operable to allow said image forming units to be individually removed from said group after being pulled out of said main body together.

7. A color electronic photographic apparatus as recited in claim 1, further comprising carrying control means for controlling said transfer carrying means to move the transfer material in a single direction along said path when in a single color mode and to move the transfer material along said path in a reciprocating manner when in a multiple color mode.

8. A color electronic photographic apparatus as recited in claim 1, further comprising discharging means attached to said plurality of image forming units opposite said transfer carrying means for facilitating discharge of the transfer material from said transfer carrying means.

9. A color electronic photographic apparatus as recited in claim 8, wherein said discharge means comprises a plurality of discharge units respectively attached to said plurality of image forming units.

10. A color electronic photographic apparatus as recited in claim 9, further comprising control means for controlling said moving means and said transfer carrying means so that none of said image forming units is positioned in said light exposing position except during transfer of the toner image from said electrostatic image carriers to the transfer material, and so that said transfer carrying means abuts only against said electrostatic image carrier of the one of said image forming units disposed in said image forming position.

11. A color electronic photographic apparatus as recited in claim 10, further comprising mounting means for mounting said image forming units in said main body in such a manner that said image forming units can be pulled out of said main body together as an image forming unit group.

12. A color electronic photographic apparatus comprising:

a main body;

a plurality of image forming units movably mounted in said main body, each of said image forming units including a rotatable electrostatic image carrier and a developing means for developing a toner image on said electrostatic image carrier, the toner images developed by the developing means of the image forming units being of different colors, respectively;

transferring means for transferring the toner images from said electrostatic image carriers onto a transfer material at a single predetermined transfer position;

moving means for sequentially moving each of the image forming units to a single predetermined image forming position opposite said transfer position;

a light exposing means for effecting an image light exposing operation at a single predetermined light exposing position which corresponds to said image forming position;

a transfer carrying means for carrying the transfer material along a predetermined path which extends through said transfer position;

fixing means mounted in said maim body downstream of said transfer position for fixing the toner images on the transfer material; and control means for controlling an operating speed of said fixing means and a speed of said transfer carrying means, and for controlling the speed of said transfer carrying means during transfer of the toner images from aid electrostatic image carriers to the transfer material to be different than the operation speed of said fixing means and the speed of said transfer carrying means after transfer of the toner images from said electrostatic image carriers to the transfer material;

whereby toner images of different colors can be superposed on the transfer material to form color images.

13. A color electronic photographic apparatus comprising:

a main body;

a plurality of image forming units movably mounted in said main body, each of said image forming units including a rotatable electronic image carrier and a developing means for developing a toner image on said electrostatic image carrier, the toner images developed by the developing means of the image forming units being of different colors, respectively;

transferring means for transferring the toner images from said electrostatic image carriers onto a transfer material at a single predetermined transfer position;

moving means for sequentially moving each of the image forming units to a single predetermined image forming position opposite said transfer position;

a light exposing means for effecting an image light exposing operation at a single predetermined light exposing position which corresponds to said image forming position;

a transfer carrying means for carrying the transfer material along a predetermined path which extends through said transfer position;

first cleaning means for cleaning surfaces of said electrostatic image carriers;

second cleaning means for cleaning said transfer carrying means;

an excess toner reservoir; and coupling means for coupling both said first and second cleaning means to said excess toner reservoir.

14. A color electronic photographic apparatus as recited in claim 13, wherein said first cleaning means comprises a plurality of cleaning units operably connected with said plurality of image forming units, respectively.

15. A color electronic photographic apparatus comprising:

a main body;

an image forming unit group comprising a plurality of image forming units in a straight line and movably mounted in said main body for movement along said straight each of said image forming units including a rotatable electrostatic image carrier and a developing means for developing a toner image on said electrostatic image carrier, the toner images developed by the developing means of the image forming units being of different colors, respectively, transferring means for transferring the toner images from said electrostatic image carriers onto a transfer material at a single predetermined transfer position along said line;

moving means for moving said image forming unit group to sequentially position each of said image forming units at a single predetermined image forming position opposite said transfer position;

a light exposing means for effecting an image light exposing operation at a single predetermined light exposing position which corresponds to said image forming position; and a transfer carrying means for carrying the transfer material along a predetermined path which extends through said transfer position;

whereby toner images of different colors can be superposed on the transfer material to form color images.

16. A color electronic photographic apparats as recited in claim 15, further comprising discharging means attached to said image forming unit group opposite said transfer carrying means for facilitating discharge of the transfer material from said transfer carrying means.

17. A color electronic photographic apparatus as recited in claim 16, wherein said discharge means comprises a plurality of discharge units respectively attached to said plurality of image forming units.

18. A color electronic photographic apparatus as recited in claim 17, further comprising control means for controlling said moving means and said transfer carrying means so that none of said image forming units is positioned in said light exposing position except during transfer of the toner image from said electrostatic image carriers to the transfer material, and so that said transfer carrying means abuts only against said electrostatic image carrier of the one of said image forming units disposed in said image forming position.

19. A color electronic photographic apparatus as recited in claim 18, further comprising mounting means for mounting said image forming unit group in said main body in such a manner that said image forming units can be pulled out of said main body together as said image forming unit group.

20. A color electronic photographic apparatus as recited in claim 19, wherein said mounting means is operable to allow said image forming units to be individually removed from said image forming unit group after being pulled out of said main body together.

* * * * *